US009879930B2

(12) United States Patent
Cassels

(10) Patent No.: US 9,879,930 B2
(45) Date of Patent: Jan. 30, 2018

(54) COMPACT ACTION SPRING AND BUFFER ASSEMBLY

(71) Applicant: Charles B. Cassels, New Smyrna Beach, FL (US)

(72) Inventor: Charles B. Cassels, New Smyrna Beach, FL (US)

( * ) Notice: Subject to any disclaimer, the term of this patent is extended or adjusted under 35 U.S.C. 154(b) by 0 days.

(21) Appl. No.: 15/409,920

(22) Filed: Jan. 19, 2017

(65) Prior Publication Data

US 2017/0205164 A1 Jul. 20, 2017

Related U.S. Application Data

(60) Provisional application No. 62/280,188, filed on Jan. 19, 2016.

(51) Int. Cl.

| | |
|---|---|
| ***F41A 3/78*** | (2006.01) |
| ***F41A 3/84*** | (2006.01) |
| ***F41C 23/06*** | (2006.01) |
| ***F41C 23/20*** | (2006.01) |

(52) U.S. Cl.
CPC ..... *F41A 3/84* (2013.01); *F41C 23/06* (2013.01); *F41C 23/20* (2013.01)

(58) Field of Classification Search
CPC ..... F41A 3/84; F41C 23/06
See application file for complete search history.

(56) References Cited

U.S. PATENT DOCUMENTS

| | | | | |
|---|---|---|---|---|
| 5,726,377 | A * | 3/1998 | Harris | F41A 19/14 42/65 |
| 5,941,005 | A * | 8/1999 | Battaglia | F41A 5/10 42/70.08 |
| 6,829,974 | B1 * | 12/2004 | Gwinn, Jr. | F41A 3/70 89/130 |
| 8,375,616 | B2 | 2/2013 | Gomez et al. | |
| 8,387,513 | B2 | 3/2013 | Gomez et al. | |
| 9,459,060 | B2 * | 10/2016 | Langevin | F41A 3/66 |
| 2010/0151588 | A1 * | 6/2010 | Angel | A61K 38/1709 436/501 |
| 2010/0282064 | A1 * | 11/2010 | Bantle | F41C 9/06 89/179 |
| 2012/0137869 | A1 | 6/2012 | Gomez et al. | |
| 2012/0152105 | A1 | 6/2012 | Gomez et al. | |
| 2017/0160028 | A1 * | 6/2017 | Martinez, Jr. | F41A 3/80 |

* cited by examiner

*Primary Examiner* — Gabriel J. Klein
(74) *Attorney, Agent, or Firm* — Carter, DeLuca, Farrell & Schmidt, LLP

(57) ABSTRACT

The present application is directed to a firearm including an action spring and a buffer assembly including a buffer body defining a counterweight bore having a first length and a counterweight received within the counterweight bore. The buffer body has a first end defining a face and a second end. The counterweight has a second length less than the first length. A buffer bumper is supported on the second end of the buffer body and a buffer pad is positioned within the counterweight bore between the counterweight and the first end of the buffer body. A bolt carrier is positioned to engage the face of the buffer body. An action spring is positioned about the buffer body and extends between the receiver extension of the firearm and the buffer body.

8 Claims, 4 Drawing Sheets

COMPACT ACTION SPRING AND BUFFER ASSEMBLY

CROSS-REFERENCE TO RELATED APPLICATION

This application claims the benefit of and priority to U.S. Provisional Application Ser. No. 62/280,188, filed Jan. 19, 2016, which is incorporated herein in its entirety by reference.

BACKGROUND

1. Technical Field

The present invention is related to firearms and, more specifically, to a compact action spring and buffer assembly for semi and fully automatic firearms.

2. Background of Related Art

The AR15 and AR10 family of firearms have utilized either the standard rifle or carbine action spring and buffer system since being invented.

A variety of recoil systems have been invented for use with the AR family of firearms and all have been in either the rifle or carbine configuration.

Attempts have been made over the years to make recoil assemblies more compact, but reliability has suffered as a result, leaving only the rifle and carbine recoil assembly suitable as a reliable option. In an effort to meet the need for a more compact recoil assembly, manufacturers like LWRC International and Troy Industries have radically altered the Original Equipment Manufacturing ("OEM") bolt carrier. Altering the OEM bolt carrier has many disadvantages including costly proprietary replacement parts, changes to assembly/disassembly procedures, loss of buffer weight tune-ability and limited compatibility with other OEM components.

SUMMARY

In embodiments of the present disclosure, a compact action spring and buffer assembly is provided. The presently disclosed compact action spring and buffer assembly has many advantages over the prior art including a more compact spring and buffer assembly that does not require replacing the OEM bolt carrier, greater compatibility with OEM components, fewer replacement parts, reduced cost, retro fit compatibility with existing AR type firearms, no change requirement to assembly or disassembly procedures, and weight adjustable buffer assembly for custom and caliber specific tuning.

In one aspect of the present disclosure, a firearm is provided including a buttstock assembly defining a receiver extension. An action spring and buffer assembly is received in the buttstock assembly and includes a buffer body defining a counterweight bore having a first length. The buffer body has a first end defining a face and a second end. A counterweight is received within the counterweight bore having a second length less than the first length. A buffer bumper is supported on the second end of the buffer body and a buffer pad is positioned between the counterweight and the first end of the buffer body. A bolt carrier is positioned to engage the face of the buffer body. An action spring is positioned about the buffer body and extends between the receiver extension of the firearm and the buffer body.

In embodiments, the buffer bumper is press fit into the second end of the of the buffer body.

In some embodiments, the buffer bumper is secured to the second end of the buffer body by a retaining pin.

In certain embodiments, the second end of the buffer body defines a shoulder and the action spring is received about the buffer body in engagement with the shoulder.

In embodiments, the buffer bumper is press-fit into the second end of the buffer body such that the buffer body is air tight to prevent entry of debris into the buffer body.

In some embodiments, the buffer bumper is removeable from the buffer body to allow replacement of the counterweight.

In certain embodiments, the buffer body is formed from a high density material with a weight sufficient to reduce a length required for the buffer body.

In another aspect, the present disclosure is directed to an action spring and buffer assembly kit including a buffer body defining a counterweight bore having a first closed end and a second open end. A buffer bumper is adapted to be partially received within the counterweight bore. The kit also includes a plurality of counterweights, wherein each of the counterweights is dimensioned to be slidably received within the counterweight bore and each of the counterweights has a different weight to facilitate tuning of a firearm.

In embodiments, the kit further includes a buffer pad configured to be received within the counterweight-bore between one of the plurality of counterweights and the first closed end of the buffer body.

BRIEF DESCRIPTION OF THE DRAWINGS

Various embodiments of the presently disclosed firearm including a compact action spring and buffer assembly are described herein with reference to the drawings, wherein.

DETAILED DESCRIPTION OF EMBODIMENTS

Figure 1:
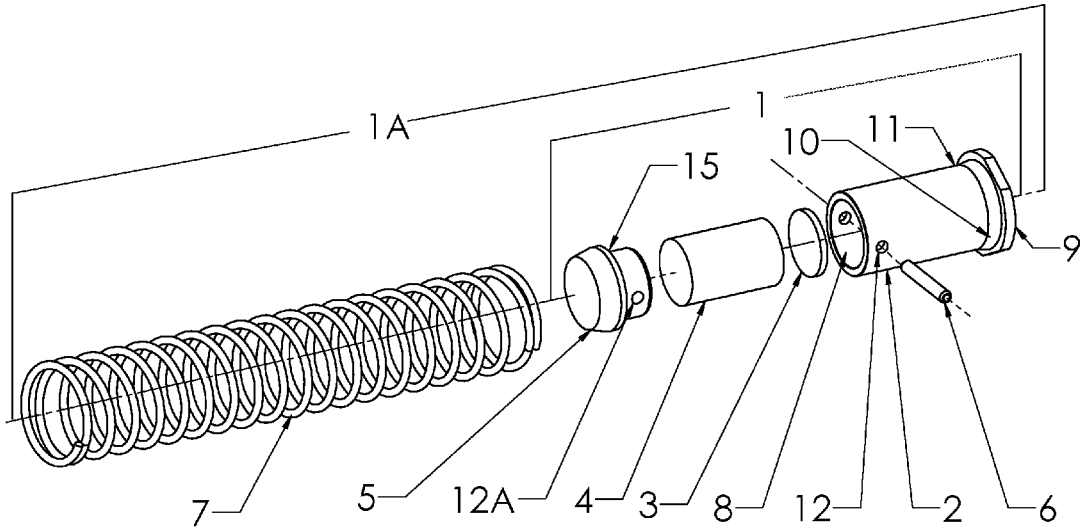
FIG. 1 is an exploded side, perspective view of the presently disclosed compact action spring/buffer assembly.

Embodiments of the presently disclosed compact action spring and buffer assembly will now be described in detail with reference to the drawings wherein like reference numerals designate identical or corresponding elements in each of the several views.

The detailed description set forth below in connection with the appended drawings is intended as a description of selected embodiments of the disclosure and is not intended to represent the only forms in which the present embodiments may be constructed and/or utilized. The description sets forth the functions and the sequence of steps for constructing and operating the selected embodiments. However, it is to be understood that the same or equivalent functions and sequences may be accomplished by different embodiments that are also intended to be encompassed within the spirit and scope of this disclosure.

Exemplary embodiments of the present disclosure are shown in FIGS. 1-4. Looking first at FIG. 1, the compact action spring and buffer assembly (1A) is shown in an exploded view, with dashed lines indicating the order and way of assembly. The primary parts of the compact action spring and buffer assembly (1A) includes a buffer body (2), a buffer pad (3), a counterweight (4), a buffer bumper (5), a retaining pin (6), and an action spring (7). The parts that make up the buffer body assembly (1) include the buffer body (2), the buffer pad (3), the counterweight (4), the buffer bumper (5), and the retaining pin (6). The buffer body (2) defines a counterweight bore (8) starting at one end of the buffer body (2) and bottoming out on the inside of a buffer body face (9). The buffer body (2) also forms an enlarged ring (10) and buffer body shoulder (11). The enlarged ring (10) defines a raised surface that provides a surface for the action spring (7) to snap onto. More specifically, the enlarged ring (10) receives one end of the action spring (7) in tension to secure the action spring (7) to the buffer body (2). The buffer body shoulder (11) fixes the action spring (7) with the rear of the buffer body face (9) providing the structure for the action spring (7) to actuate the bolt carrier (13) of a firearm (14). The buffer body (2) has a retaining pin hole (12) that traverses through the counterweight bore (8) and retains the buffer bumper (5) within the counterweight bore (8). Alternately, other securement techniques can be used to secure the buffer bumper (5) to the buffer body (2). The buffer bumper (5) is configured with a smaller diameter at one end that is press fit into the counterweight bore (8) creating an air tight seal with the counterweight bore (8), and at the other end forms a bumper shoulder (15) that fits flush with the end of the buffer body (2). The buffer bumper (5) has a retaining pin hole (12A) traversing at its small diameter end that aligns with the retaining pin holes (12) of the buffer body (2) providing the means to secure the buffer bumper (5) to the buffer body (2) with retaining pin (6). The buffer body (2) when assembled captures the counterweight (4) within the counterweight bore (8) between the buffer pad (3) and the buffer bumper (5).

In embodiments, the counterweight (4) is a solid, cylindrical member formed from a high density material such as tungsten. Further, the buffer bumper (5) is formed from a material having a durometer value of between 80 A-95 A such as urethane and the buffer pad (3) is formed from a material having a durometer value of between 65 A and 70 A such as various urethanes or rubbers. Moreover, the buffer body (2) can be formed of a non-magnetic, corrosion resistant material such as an austenitic stainless steel or aluminum. In the presently disclosed embodiments, the buffer body (2) may be formed from a 200 series or 300 series austenitic stainless steel such as a 303 stainless steel. Alternately other materials of construction are envisioned. The use of an austenitic stainless steel is advantageous over aluminum because austenitic stainless steel adds weight to the buffer body (2) as compared to aluminum while retaining the nonmagnetic and corrosion resistance properties of aluminum.

In embodiments, the buffer body assembly (1) has a weight of between about 3 ounces and about 5.4 ounces. In certain embodiments, the buffer body assembly (1) has a weight of between about 3 ounces and about 8 ounces. In some embodiments, the weight of the buffer body assembly (1) is about 4.4 ounces. In other embodiments, the weight of the buffer body assembly (1) is about 4.62 ounces.

In embodiments, the action spring (7) has a wire size of between 0.065 inches and 0.075 inches and may be about 0.072 inches. In other embodiments, the action spring (7) has a wire size of between 0.058 inches and 0.075 inches and may be about 0.068 inches. In addition, the action spring (7) has a free length of from about 7.620 inches to about 11.23 inches and may be about 7.620 inches, an inside diameter of from about 0.725 inches to about 0.826 inches and may be about 0.826 inches, an outside diameter of from about 0.855 inches to about 0.985 inches and may be about 0.970 inches, and includes from about 18 to about 26.53 coils. In embodiments, the action spring (7) has about 16.1 active coils and 18.1 total coils.

In embodiments, the buffer body (2) has a diameter of between about 0.700 inches and 0.800 inches and a length of from about 1.170 inches to about 2.297 inches; the buffer bumper (5) has a diameter of from about 0.600 inches to about 0.800 inches and a length of from about 0.200 inches to about 0.625 inches; the counterweight has a diameter of from about 0.600 inches to about 0.750 inches and a length of from about 0.490 inches to about 1.000 inch; and the buffer pad (3) has a diameter of from about 0.600 inches to about 0.750 inches and a length of from about 0.030 inches to about 0.525 inches. In other embodiments, the length of the counterweight is from about 0.340 inches to about 1.660 inches. In embodiments, the buffer body (2) has a diameter of about 0.787 inches and a length of about 1.475 inches, the buffer bumper has a diameter of about 0.643 inches and a length of about 0.550 inches, the counterweight (4) has a diameter of about 0.625 inches and a length of about 0.950 inches, and the buffer pad (3) has a diameter of about 0.625 inches and a length of about 0.065 inches. In other embodiments, the buffer body (2) has a diameter of about 0.800 inches and a length of about 1.587 inches, the buffer bumper has a diameter of about 0.600 inches and a length of about 0.550 inches, the counterweight (4) has a diameter of about 0.625 inches and a length of about 0.950 inches, and the buffer pad (3) has a diameter of about 0.625 inches and a length of about 0.065 inches.

Figure 2:
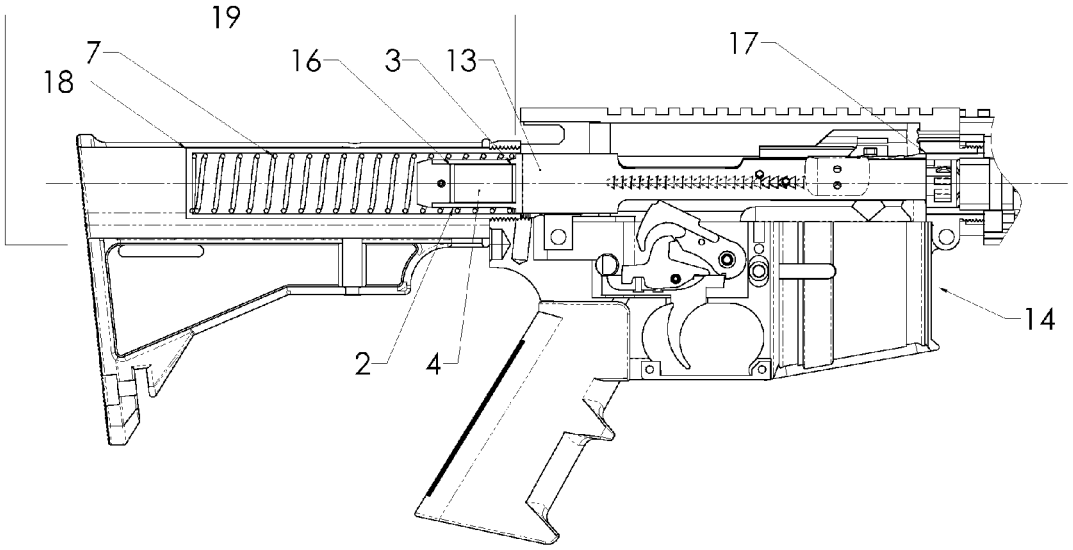
FIG. 2 is a cutaway showing the compact action spring/buffer assembly shown in FIG. 1 installed in a firearm in its forward most position.

Referring to FIGS. 1 and 2, a firearm (14) is shown with the compact action spring and buffer assembly (1A) installed. The action spring (7) preloads the bolt carrier (13) and the buffer body (2) acts as a supporting structure between the bolt carrier (13) and the action spring (7). A throw space (16) is defined within the buffer body (2) to allow the counterweight (4) to be thrown forward and aft as the firearm (14) recoil cycle actuates.

Figure 3:
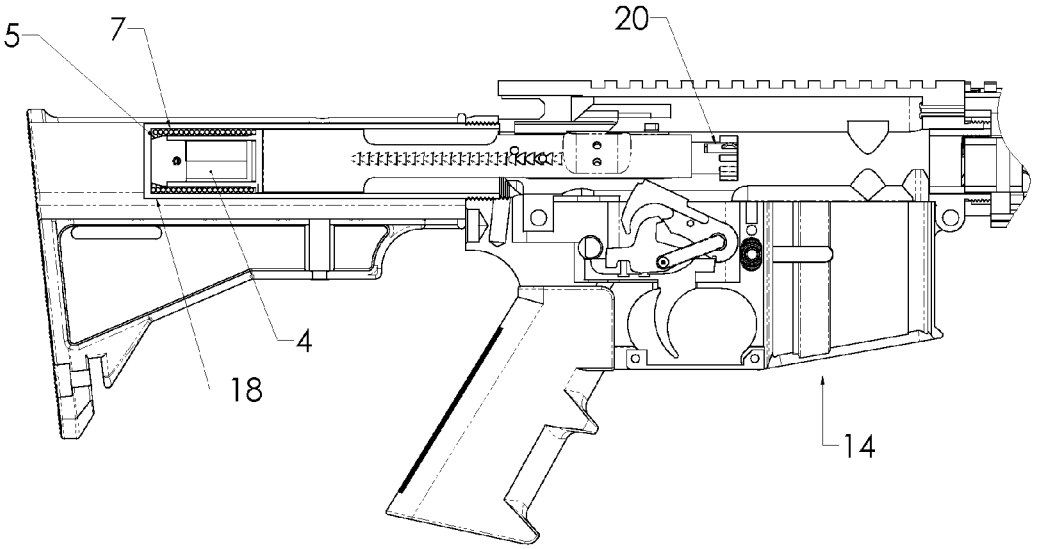
FIG. 3 is a cutaway showing the compact action spring/buffer assembly shown in FIG. 1 installed in a firearm in its fully compressed position.

Referring to FIG. 3, when the action spring (7) is fully compressed, the buffer bumper (5) is bottomed out on a receiver extension (18) of the firearm (14) and the counterweight (4) is thrown rearwardly against the buffer bumper (5). This illustrates how the compact action spring and buffer assembly (1) is positioned at the most rearward point in the firearm (14) recoil cycle.

Figure 4:
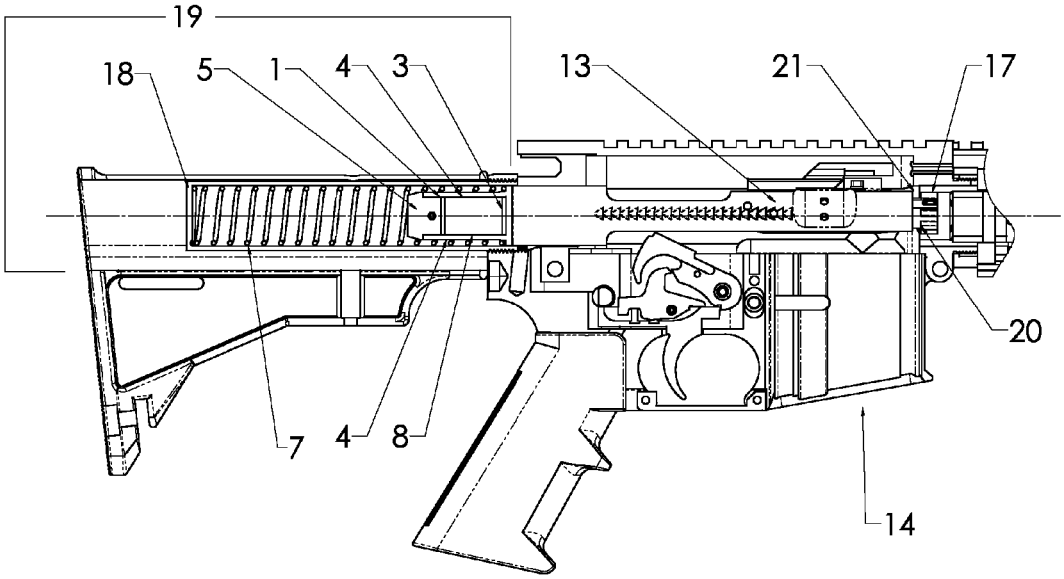
FIG. 4 is a cutaway showing bolt carrier movement within the barrel extension during firing of the firearm.

Referring to FIGS. 1 and 4, a small gap is defined between the barrel extension (17) and the bolt carrier (13). This small gap is referred to as bolt carrier bounce (21). Bolt carrier bounce (21) is the primary reason why a more compact buttstock assembly (19) has not been possible before. For a firearm to cycle reliably, bolt carrier bounce (21) must be mitigated. Bolt carrier bounce (21) is caused by the bolt carrier (13) impacting the barrel extension (17) at high velocity, rebounding rearward creating space between a firing pin of the firearm (14) and ammunition primer resulting in a misfire. The compact action spring and buffer assembly (1A) mitigates bolt carrier bounce (21) by having the counterweight (4) thrown forward simultaneously as the bolt carrier (13) rebounds off the barrel extension (17), thus mitigating bolt carrier bounce (21).

Referring to FIGS. 1 and 4, in use, the firearm (14) fires a round and the energy from the round acts on the bolt carrier (13) causing the bolt carrier (13) to move rearward as the bolt carrier (13) overcomes the preload and inertia of the action spring and buffer body assembly (1A). The bolt carrier (13) will continue rearward until the buffer body assembly (1) bottoms out on the receiver extension (18). The buffer bumper (5) has material properties that allow the buffer body assembly (1) and bolt carrier (13) to ride down as well as absorb shock, vibration, and prevent damage from the parts impacting one another. As used herein, the term "ride down" means brake or more gently come to a stop. Simultaneously, the counterweight (4) is thrown rearwardly within the counterweight bore (8) to slow the returning velocity of the bolt carrier (13). After the buffer body assembly (1) bottoms out on the receiver extension (18), the bolt carrier (13) and buffer body assembly (1), urged by the action spring (7) begins accelerating forward toward the barrel extension (17). During this process, the bolt (20) carried by the bolt carrier (13) strips a round from the firearm (14) magazine and chambers it through the barrel extension (17). This is followed immediately by the bolt carrier (13) impacting the barrel extension (17). At this point, a conventional bolt carrier (13), left unimpeded, would rebound off the barrel extension (17) causing a malfunction known as bolt carrier bounce (21). With the presently disclosed compact action spring and buffer assembly (1A), bolt carrier bounce (21) is arrested by the counterweight (4) and buffer pad (3) working in concert. At the instant bolt carrier bounce (21) would occur, the counterweight (4) is thrown forward against the buffer pad (3) creating a dead blow that halts bolt carrier bounce (21) making the firearm (14) reliable with the shortest possible buttstock assembly (19).

Persons skilled in the art will understand that the devices and methods specifically described herein and illustrated in the accompanying drawings are non-limiting exemplary embodiments. It is envisioned that the elements and features illustrated or described in connection with one exemplary embodiment may be combined with the elements and features of another without departing from the scope of the present disclosure. As well, one skilled in the art will appreciate further features and advantages of the disclosure based on the above-described embodiments. Accordingly, the disclosure is not to be limited by what has been particularly shown and described, except as indicated by the appended claims.

What is claimed is:

1. A firearm comprising:

a buttstock assembly defining a receiver extension;

an action spring and buffer assembly including a buffer body defining a counterweight bore having a first length, the buffer body having a diameter of between 0.700 inches and 0.800 inches, a length of between 1.170 inches and 2.297 inches, a first end defining a face and a second end, a counterweight received within the counterweight bore, the counterweight having a second length less than the first length, a buffer bumper supported on the second end of the buffer body, the buffer bumper having a diameter of from 0.600 inches to 0.800 inches and a length from 0.200 inches to 0.625 inches, and a buffer pad positioned between the counterweight and the first end of the buffer body;

a bolt carrier positioned to engage the face of the buffer body; and an action spring positioned about the buffer body, the action spring extending between the receiver extension of the firearm and the buffer body and having a wire size of 0.058 inches to 0.075 inches and a free length of 7.620 inches to 11.23 inches;

wherein the buffer body, the counter weight, and the buffer bumper define a buffer assembly having a weight of between 3 ounces and 8 ounces.

2. The firearm of claim 1, wherein the buffer bumper is press fit into the second end of the of the buffer body.

3. The firearm of claim 1, wherein the buffer bumper is secured to the second end of the buffer body by a retaining pin.

4. The firearm of claim 1, wherein the second end of the buffer body defines a shoulder, the action spring being received about the buffer body in engagement with the shoulder.

5. The firearm of claim 1, wherein the buffer bumper is press-fit into the second end of the buffer body such that the buffer body is air tight to prevent entry of debris into the buffer body.

6. The firearm of claim 1, wherein the buffer bumper is removeable from the buffer body to allow replacement of the counterweight.

7. The firearm of claim 1, wherein the buffer body is formed from a high density material.

8. The firearm of claim 1, wherein the buffer body is formed from an austenitic stainless steel.

* * * * *